US006893115B2

(12) United States Patent
Hadimioglu et al.

(10) Patent No.: US 6,893,115 B2
(45) Date of Patent: May 17, 2005

(54) FREQUENCY CORRECTION FOR DROP SIZE CONTROL

(75) Inventors: Babur Hadimioglu, Stockholm (SE); Richard N. Ellson, Palo Alto, CA (US)

(73) Assignee: Picoliter Inc., Sunnyvale, CA (US)

( * ) Notice: Subject to any disclaimer, the term of this patent is extended or adjusted under 35 U.S.C. 154(b) by 379 days.

(21) Appl. No.: 10/251,916

(22) Filed: Sep. 20, 2002

(65) Prior Publication Data

US 2004/0056931 A1 Mar. 25, 2004

(51) Int. Cl.[7] ..... B41J 2/135
(52) U.S. Cl. ..... 347/46
(58) Field of Search ..... 347/46, 44, 40, 347/39, 47; 264/9, 7, 5; 422/100

(56) References Cited

U.S. PATENT DOCUMENTS

| | | | | |
|---|---|---|---|---|
| 4,308,547 | A | 12/1981 | Lovelady et al. | |
| 4,697,195 | A | 9/1987 | Quate et al. | |
| 4,751,529 | A | 6/1988 | Elrod et al. | |
| 5,041,849 | A | 8/1991 | Quate et al. | |
| 5,122,818 | A | 6/1992 | Elrod et al. | |
| 5,268,610 | A | 12/1993 | Hadimioglu et al. | |
| 5,389,956 | A | 2/1995 | Hadimioglu et al. | |
| 5,612,723 | A | 3/1997 | Shimura et al. | |
| 5,798,779 | A | 8/1998 | Nakayasu et al. | |
| 6,302,524 | B1 * | 10/2001 | Roy | 347/46 |
| 6,416,164 | B1 | 7/2002 | Stearns et al. | |
| 6,596,239 | B2 * | 7/2003 | Williams et al. | 422/100 |
| 6,610,223 | B2 * | 8/2003 | Lee | 264/9 |
| 6,802,593 | B2 * | 10/2004 | Ellson et al. | 347/46 |
| 2002/0037375 | A1 | 3/2002 | Ellson et al. | |

FOREIGN PATENT DOCUMENTS

| | | |
|---|---|---|
| EP | 0990524 | 4/2000 |
| WO | WO 02/24325 | 3/2002 |
| WO | WO 02/47820 | 6/2002 |

OTHER PUBLICATIONS

U.S. Appl. No. 09/669,996, filed Sep. 25, 2000, Ellson et al.
U.S. Appl. No. 09/727,392, filed Nov. 29, 2000, Mutz et al.
U.S. Appl. No. 09/765,947, filed Jan. 19, 2001, Mutz et al.
Elrod et al. (1989), "Nozzleless Droplet Formation with Focused Acoustic Beams," *J. Appl. Phys.* 65(9):3441–3447.

* cited by examiner

*Primary Examiner*—K. Feggins
(74) *Attorney, Agent, or Firm*—Dianne E. Reed; Reed Intellectual Property Law Group

(57) ABSTRACT

The present invention provides a method and device for the acoustic ejection of fluid droplets having a constant drop size from fluid-containing reservoirs having varying fluid heights contained therein without the need for repositioning the acoustic ejector in the z direction by adjusting the RF frequency and amplitude. In one embodiment, the device is comprised of: a plurality of reservoirs each adapted to contain a fluid; an ejector comprising a means for generating acoustic radiation, means for controlling the RF frequency and amplitude used to generate the acoustic radiation, means for focusing the acoustic radiation at a focal point near the fluid surface in each of the reservoirs; and a means for positioning the ejector in acoustically coupled relationship to each of the reservoirs. The invention is useful in a number of contexts, particularly in the preparation of biomolecular arrays.

43 Claims, 3 Drawing Sheets

FREQUENCY CORRECTION FOR DROP SIZE CONTROL

TECHNICAL FIELD

This invention relates generally to the use of focused acoustic energy in the ejection of fluids, and more particularly relates to methods for controlling the size and velocity of droplets ejected.

BACKGROUND

A number of patents have described the use of acoustic energy in droplet ejection. For example, U.S. Pat. No. 4,308,547 to Lovelady et al. describes a liquid drop emitter that utilizes acoustic principles in ejecting liquid from a body of liquid onto a moving document for forming characters or bar codes thereon. Lovelady et al. is directed to a nozzleless inkjet printing apparatus wherein controlled drops of ink are propelled by an acoustical force produced by a curved transducer at or below the surface of the ink.

The Lovelady et al. patent makes use of a piezoelectric shell transducer to both generate and focus the acoustic energy. Several other methods have also been developed to focus the generated acoustic energy and eject a droplet of liquid. For example, acoustically illuminated spherical acoustic focusing lenses as described in U.S. Pat. No. 4,751,529 to Elrod et al. and planar piezoelectric transducers with interdigitated electrodes as described in U.S. Pat. No. 4,697,105 to Quate et al. The existing droplet ejector technology has been used in designing various printhead configurations, ranging from relatively simple, single ejector embodiments for raster output scanners (ROS's) to more complex embodiments, such as one or two dimensional, full page width arrays of droplet ejectors for line printing. It has also found use in the synthesis of arrays of biological materials, as described in co-pending, commonly assigned applications Ser. No. 09/669,996, "ACOUSTIC EJECTION OF FLUIDS FROM A PLURALITY OF RESERVOIRS," filed Sep. 25, 2000, Ser. No. 09/727,392, "FOCUSED ACOUSTIC ENERGY IN THE PREPARATION AND SCREENING OF COMBINATORIAL LIBRARIES," filed Nov. 29, 2000, and Ser. No. 09/765,947, "HIGH THROUGHPUT BIOMOLECULAR CRYSTALLIZATION AND BIOMOLECULAR CRYSTAL SCREENING," filed Jan. 19, 2001.

However, in acoustic radiation ejection, the width of the ultrasonic beam changes as a function of distance from the focusing lens. In addition, when ejecting fluids from multiple wells, it is possible that the surface of the ejected fluid could be at different heights for different wells due to manufacturing tolerances and variations in dispensed volumes. Therefore, the size of the ejected drops from different wells could show some variation, as the drop size is proportional to the width of the acoustic beam. Such a variation in drop size is generally undesirable. There is therefore, a need in the art for a method of maintaining a constant drop volume despite possible variation in the fluid height.

U.S. Pat. No. 5,268,610 to Hadimioglu, et. al. describes an acoustic drop emitting system where the drop size is modulated by varying the RF frequency by a factor of two to obtain fine gray levels in a printer system using acoustic ejection. U.S. Pat. No. 5,389,956 by Hadimioglu, et. al., demonstrates various techniques for improving drop velocity uniformity in an acoustic printing system that utilizes multiple acoustic drop ejectors. U.S. Pat. No. 5,612,723 to Shimura et al. discusses a method of altering drop size with a single fluid by variation in focal size. Shimura et al. teaches "defocusing" by changing the liquid level as a means of changing the drop volume and suggests altering the liquid level to produce a defocused beam to make larger droplets.

While above-discussed patents described some of the principles behind the invention described herein, they fail to provide a specific description of a system and method for drop size correction suitable for use in an acoustic drop ejection system utilizing multiple wells wherein there is variation in the height of the ejected fluids in different wells.

Also, the references discussed above are restricted to low F-number systems, i.e., systems in which the ratio of the distance from the focusing means to the focal point of the generated acoustic beam to the width of the acoustic beam at the focusing means is approximately about 1 or less. Unfortunately, low F-number lenses place restrictions on the reservoir and fluid level geometry and provide relatively limited depth of focus, increasing the sensitivity to the fluid level in the reservoir. For example, in bimolecular array applications the various bimolecular materials from which the array is constructed are usually contained in individual wells in a well plate. These wells often have aspect ratios of approximately 5:1, i.e., the wells are five times as deep as their width. The narrowness of the wells requires that, when F1 lenses are used, the surface of the fluid within the reservoir be no further from the lens than the width of the well. Therefore, when using an F1 lens in a 5:1 aspect ratio well, only the bottom fifth of the reservoir may be filled with fluid.

Furthermore, the prior art fails to describe any systems or methods that maintain a constant drop size when there are variations in fluid heights without the need for maintaining focus relative to the fluid surface or changing to relative position of the lens with respect to the fluid surface as the lens moves from reservoir to reservoir. Thus, there is a need in the art for a method that enables fine control of drop size in multi-well acoustic ejection applications without requiring an additional fast motion system to adjust the transducer-to-meniscus gap.

SUMMARY OF THE INVENTION

Accordingly, it is an object of the present invention to provide devices and methods that overcome the above-mentioned disadvantages of the prior art. In one aspect of the invention, a device is provided for acoustically ejecting a plurality of fluid droplets toward a designated site on a substrate surface, comprising a reservoir adapted to contain a fluid and having an aperture that enables conduction of acoustic energy in a substantially uniform manner, an ejector comprised of (i) an acoustic radiation generator for generating acoustic radiation and (ii) a focusing means capable of focusing the generated acoustic radiation to emit a droplet from a surface of a fluid contained within the fluid reservoir said surface being a measurable distance from said focusing means, a variable frequency and amplitude RF signal generator in electrical communication with the ejector; means for determining the measurable distance, and means for selecting the frequency and amplitude of the RF signal to be communicated to the acoustic energy generator using the measurable distance, thereby enabling ejection of a droplet having the desired size and velocity. The device may further comprise a means for positioning the ejector in acoustic coupling relationship to the reservoir and may comprise a plurality of reservoirs each adapted to contain a fluid, and wherein the device is capable of ejecting a fluid droplet of the same size and velocity from each of the plurality of reservoirs toward a plurality of designated sites on the substrate surface.

In another aspect, the invention relates to a method for ejecting a fluid from a fluid reservoir toward designated sites on a substrate surface, comprising providing a device as described above, positioning the ejector so as to be in acoustically coupled relationship to the fluid reservoir, measuring the distance from the surface of the fluid to the focusing means, selecting the frequency and the amplitude of the RF signal to be communicated to the acoustic energy generator based on the measured distance, and then activating the ejector to generate acoustic radiation, thereby ejecting a droplet of fluid having the desired volume and velocity from the fluid reservoir. If desired, the method may be repeated with a plurality of fluid reservoirs, each containing a fluid, with each reservoir generally although not necessarily containing a different fluid and generally although not necessarily containing a fluid with a surface at a different measurable distance. The acoustic ejector is repeatedly repositioned so as to eject a droplet of a desired size and velocity from each reservoir toward a different designated site on a substrate surface or into a partially filled or empty well in a microplate. In such a way, the method is readily adapted for use in generating an array of molecular moieties on a substrate surface.

BRIEF DESCRIPTION OF THE DRAWINGS

FIG. 4*a* shows the acoustic ejector acoustically coupled to the first reservoir and having been activated in order to eject a droplet of fluid from within the first reservoir toward a designated site on a substrate surface. FIG. 4*b* shows the acoustic ejector acoustically coupled to a second reservoir.

DETAILED DESCRIPTION OF THE INVENTION

Figure 1:
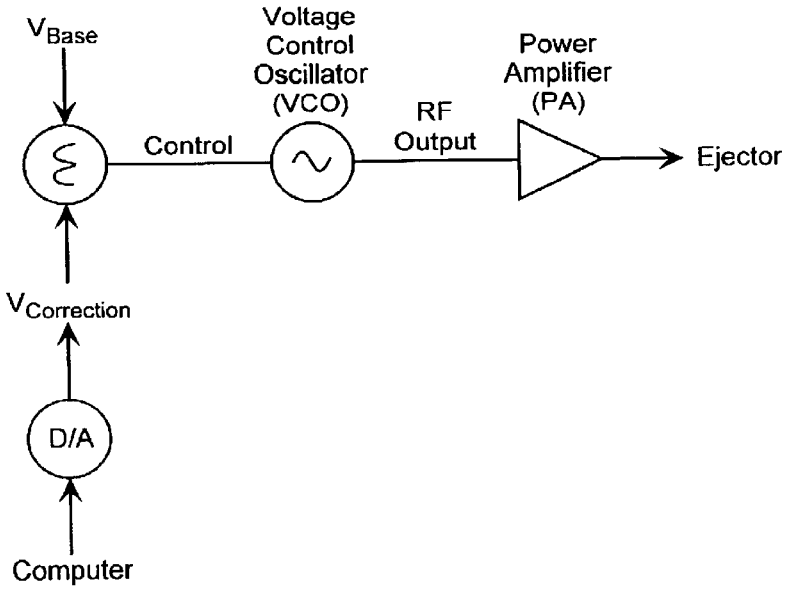
FIG. 1 schematically diagrams an embodiment of the invention wherein a voltage-controlled oscillator is used to generate the RF signal.

Definitions:

Before describing the present invention in detail, it is to be understood that this invention is not limited to specific fluids, biomolecules or device structures, as such may vary. It is also to be understood that the terminology used herein is for the purpose of describing particular embodiments only, and is not intended to be limiting.

It must be noted that, as used in this specification and the appended claims, the singular forms "a," "an" and "the" include plural referents unless the context clearly dictates otherwise. Thus, for example, reference to "a reservoir" includes a plurality of reservoirs, reference to "a fluid" includes a plurality of fluids, reference to "a biomolecule" includes a combination of biomolecules, and the like.

In describing and claiming the present invention, the following terminology will be used in accordance with the definitions set out below.

The terms "acoustic coupling" and "acoustically coupled" used herein refer to a state wherein an object is placed in direct or indirect contact with another object so as to allow acoustic radiation to be transferred between the objects without substantial loss of acoustic energy. When two items are indirectly acoustically coupled, an "acoustic coupling medium" is needed to provide an intermediary through which acoustic radiation may be transmitted. Thus, an ejector may be acoustically coupled to a fluid, e.g., by immersing the ejector in the fluid or by interposing an acoustic coupling medium between the ejector and the fluid to transfer acoustic radiation generated by the ejector through the acoustic coupling medium and into the fluid.

The term "adsorb" as used herein refers to the noncovalent retention of a molecule by a substrate surface. That is, adsorption occurs as a result of noncovalent interaction between a substrate surface and adsorbing moieties present on the molecule that is adsorbed. Adsorption may occur through hydrogen bonding, van der Waal's forces, polar attraction or electrostatic forces (i.e., through ionic bonding). Examples of adsorbing moieties include, but are not limited to, amine groups, carboxylic acid moieties, hydroxyl groups, nitroso groups, sulfones and the like.

The term "array" used herein refers to a two-dimensional arrangement of features such as an arrangement of reservoirs (e.g., wells in a well plate) or an arrangement of fluid droplets or molecular moieties on a substrate surface (as in an oligonucleotide or peptidic array). Arrays are generally comprised of regular, ordered features, as in, for example, a rectilinear grid, parallel stripes, spirals, and the like, but non-ordered arrays may be advantageously used as well. An array differs from a pattern in that patterns do not necessarily contain regular and ordered features. Arrays typically but do not necessarily comprise at least about 4 to about 10,000,000 features, generally in the range of about 4 to about 1,000,000 features.

The term "attached," as in, for example, a substrate surface having a molecular moiety "attached" thereto (e.g., in the individual molecular moieties in arrays generated using the methodology of the invention) includes covalent binding, adsorption, and physical immobilization. The terms "binding" and "bound" are identical in meaning to the term "attached."

The term "biomolecule" as used herein refers to any organic molecule, whether naturally occurring, recombinantly produced, or chemically synthesized in whole or in part, that is, was or can be a part of a living organism. The term encompasses, for example, nucleotides, amino acids and monosaccharides, as well as oligomeric and polymeric species such as oligonucleotides and polynucleotides, peptidic molecules such as oligopeptides, polypeptides and proteins, and saccharides such as disaccharides, oligosaccharides, polysaccharides, and the like.

The term "fluid" as used herein refers to matter that is nonsolid or at least partially gaseous and/or liquid. A fluid may contain a solid that is minimally, partially or fully solvated, dispersed or suspended. Examples of fluids include, without limitation, aqueous liquids (including water per se and salt water) and nonaqueous liquids such as organic solvents and the like.

The term "reservoir" as used herein refers a receptacle or chamber for holding or containing a fluid. Thus, a fluid in a reservoir necessarily has a free surface, i.e., a surface that allows a droplet to be ejected therefrom.

The term "substrate" as used herein refers to any material having a surface onto which one or more fluids may be deposited. The substrate may be constructed in any of a number of forms such as wafers, slides, well plates, membranes, for example. In addition, the substrate may be porous or nonporous as may be required for any particular fluid deposition. Suitable substrate materials include, but are not limited to, supports that are typically used for solid phase chemical synthesis, e.g., polymeric materials (e.g., polystyrene, polyvinyl acetate, polyvinyl chloride, polyvinyl pyrrolidone, polyacrylonitrile, polyacrylamide, polymethyl methacrylate, polytetrafluoroethylene, polyethylene, polypropylene, polyvinylidene fluoride, polycarbonate, divinylbenzene styrene-based polymers), agarose (e.g., Sepharose®), dextran (e.g., Sephadex®), cellulosic polymers and other polysaccharides, silica and silica-based materials, glass (particularly controlled pore glass, or "CPG") and functionalized glasses, ceramics, and such substrates treated with surface coatings, e.g., with microporous polymers (particularly cellulosic polymers such as nitrocellulose), metallic compounds (particularly microporous aluminum), or the like. While the foregoing support materials are representative of conventionally used substrates, it is to be understood that the substrate may in fact comprise any biological, nonbiological, organic and/or inorganic material, and may be in any of a variety of physical forms, e.g., particles, strands, precipitates, gels, sheets, tubing, spheres, containers, capillaries, pads, slices, films, plates, slides, and the like, and may further have any desired shape, such as a disc, square, sphere, circle, etc. The substrate surface may or may not be flat, e.g., the surface may contain raised or depressed regions.

The term "surface modification" as used herein refers to the chemical and/or physical alteration of a surface by an additive or subtractive process to change one or more chemical and/or physical properties of a substrate surface or a selected site or region of a substrate surface. For example, surface modification may involve (1) changing the wetting properties of a surface, (2) functionalizing a surface, i.e., providing, modifying or substituting surface functional groups, (3) defunctionalizing a surface, i.e., removing surface functional groups, (4) otherwise altering the chemical composition of a surface, e.g., through etching, (5) increasing or decreasing surface roughness, (6) providing a coating on a surface, e.g., a coating that exhibits wetting properties that are different from the wetting properties of the surface, and/or (7) depositing particulates on a surface.

The language "movement in the z direction" refers to movement along the axis that is substantially parallel to the direction of the propagation of the acoustic radiation and in which the fluid drops are ejected. Typically, movement in the z direction refers to vertical movement.

In one embodiment, then, the invention pertains to a device for acoustically ejecting a droplet or droplets of a desired size toward a designated site or sites on a substrate surface. The device comprises one or more reservoirs, each adapted to contain a fluid and each having an aperture having an effective dimension that enables conduction of acoustic energy in a substantially uniform manner; an ejector comprised of an acoustic radiation generator for generating acoustic radiation, and a focusing means capable of focusing the generated acoustic radiation to emit a droplet from a surface of a fluid contained within the fluid reservoir said surface being a certain distance from the focusing means, a means for determining the distance from the surface of the fluid to the focusing means, and means for selecting the frequency and amplitude of the RF signal to be communicated to the acoustic energy generator using the measured distance, thereby enabling ejection of a droplet having the desired size and velocity. Optionally, the device also comprises a means for positioning the ejector in acoustic coupling relationship to each of the reservoirs, should there be more than one reservoir present.

Drop ejection using acoustic radiation pressure utilizes focused sound waves with sufficient intensity to generate a drop. As discussed in Elrod et al. (1989), "Nozzleless Droplet Formation with Focused Acoustic Beams," *J Appl. Phys.* 65:3441, in acoustic ejection systems the ejected drop size is approximately the width of the focused sound beam. It has also been shown in Elrod et al. that the drop size varies inversely with the RF frequency for acoustic lenses with F-numbers close to 1. The present invention discloses a method of controlling the droplet size by varying the RF frequency to compensate for variations in the beam size caused by fluctuations in the fluid height when droplets are emitted from multiple wells. A suitable procedure for use when the F-number of the focusing lens is close to 1 is outlined below.

In this method of the invention, as an initial matter and under laboratory conditions, the correlation between drop size and fluid height is determined for a given frequency, $f_n$. This correlation can be obtained via actual measurement or via calculation of beam width as a function of fluid height using known acoustic field calculation techniques such as those presented in Kino (1987), "Acoustic Waves: Devices, Imaging and Analog Signal Processing," Prentice-Hall, New Jersey. Next, the fluid to be ejected is placed into a reservoir as described below and the fluid-containing reservoir placed in acoustical communication with a droplet ejector having a focusing means and an acoustic radiation generator. Using echo ranging or any other suitable method, the height of the fluid in the reservoir with respect to the focusing means is then determined. If more than one reservoir is present, the heights of all of the fluids may be determined in a single scan. Alternatively, the height of the fluid in each reservoir may be determined for each reservoir just prior to droplet ejection. If multiple drops are to be ejected from a single reservoir, the height of the fluid is determined between each ejection and the frequency accordingly adjusted to provide of ejection of identically sized droplets.

Once the height of the fluid in the reservoir is determined, the correlation data initially obtained is used to ascertain the predicted drop size, $D_m$, for the measured fluid height. Using equation (1), the corrected RF frequency that will enable ejection of a droplet of the desired size, $D_1$, is selected.

$$RF = D_l\left(\frac{f_n}{D_m}\right) \tag{1}$$

Once the corrected RF frequency has been selected, the droplet is ejected from the well via activation of the droplet ejector using an electrical signal having the corrected RF frequency. It will be easily appreciated by one of skill in the art that the above outlined method can be applied to a plurality of fluid containing reservoirs, such as those found in a conventional and commercially available well plate. In multi-well applications, after droplet ejection from a first reservoir is completed, the ejector is repositioned under a second reservoir. The height of the fluid is then measured, if not previously measured in an initial measuring scan, the corrected frequency selected, and the correctly sized drop ejected. In such a way, variations in drop size due to variation in the height of the fluid are avoided as, for each reservoir, the frequency is adjusted to insure consistent drop size.

In applications wherein the F-number of the focusing lens is significantly larger than 1, drop size does not follow the "classical" variation with focal spot size discussed in Elrod et al. and does not possess an inverse relationship to frequency. Under these conditions, the utility of equation (1) is vastly reduced and cannot be used to select the corrected RF frequency. It is therefore necessary, when using large F-number lenses, to obtain the correlation between drop size and fluid height for a range of frequencies, thereby creating a "look-up" or reference table indicating the required frequency for a desired drop size and fluid height. The table is then used to select the corrected frequency and the drop ejected as before. Generally, the reference table is in the form of a rapidly accessible computer database. The table-based method is suitable for both low and high F-number systems as it is based on measurements rather than model results.

In certain situations it may also be necessary in order to keep the drop velocity constant to adjust the amplitude of the RF signal in addition to varying the RF frequency. By increasing or decreasing the amplitude of the RF signal, the drop velocity can be increased or decreased to compensate for fluctuations in drop velocity induced by the variation of the RF frequency. In this manner, consistent drop velocity and drop volume can be maintained. The table may also contain data relating to amplitude and droplet velocity.

In one embodiment, as shown in FIG. 1, a voltage-controlled oscillator (VCO) is used to generate the RF signal. Suitable voltage-controlled oscillators are commercially available from Mini-Circuits (Brooklyn, N.Y.), Vari-L (Denver, Colo.), and Z-Communications (San Diego, Calif.). As depicted in FIG. 1, $V_{base}$ is a nominal voltage that is applied to the VCO that results in a nominal RF frequency, i.e., $f_n$ as discussed above, and $V_{correction}$ is the computed voltage correction term based on the measured fluid height. In this method, $V_{correction}$ is determined using the information stored in the reference table and the applied voltage adjusted to that the total applied voltage supplied to the VCO is equal to $V_{base}$ plus $V_{correction}$. When multiple reservoirs are present, the total applied voltage is adjusted to correspond to the height of the fluid contained within each reservoir so that the RF correction frequency emitted by the VCO corresponds to the particular fluid height in each reservoir.

Figure 2:
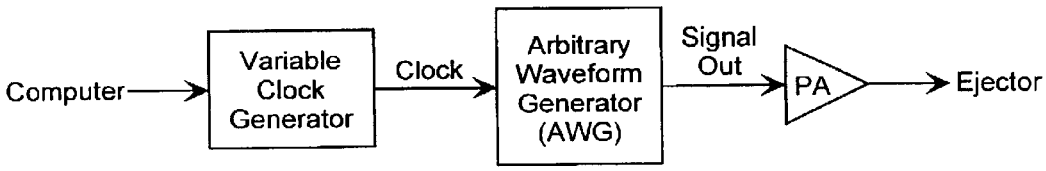
FIG. 2 schematically diagrams an embodiment of the invention wherein an arbitrary waveform generator is used to generate the RF signal.

In another embodiment, as shown in FIG. 2, the RF signal is generated using an arbitrary waveform generator (AWG). Suitable AWG's are commercially available from Stanford Research Systems (Sunnyvale, Calif.), Pragmatic (San Diego, Calif.), and Agilent (Palo Alto, Calif.). In this embodiment, the memory in AWG is loaded with a sampled form of a sine wave. Based on the measured fluid height information, the computer sends signals to a variable clock generator to set the clock frequency. This clock signal is then used to step the points stored in AWG. The frequency of the sine wave coming out of the AWG will then be modulated in response to computer control. When multiple reservoirs are present, the computer is instructed between each well to change the internal clock frequency of the AWG so that the RF frequency coming out of the AWG will correspond to the particular well height. The only constraint on this method is that there be sufficient time to execute a computer command by the AWG in between scanned wells.

Figure 3:
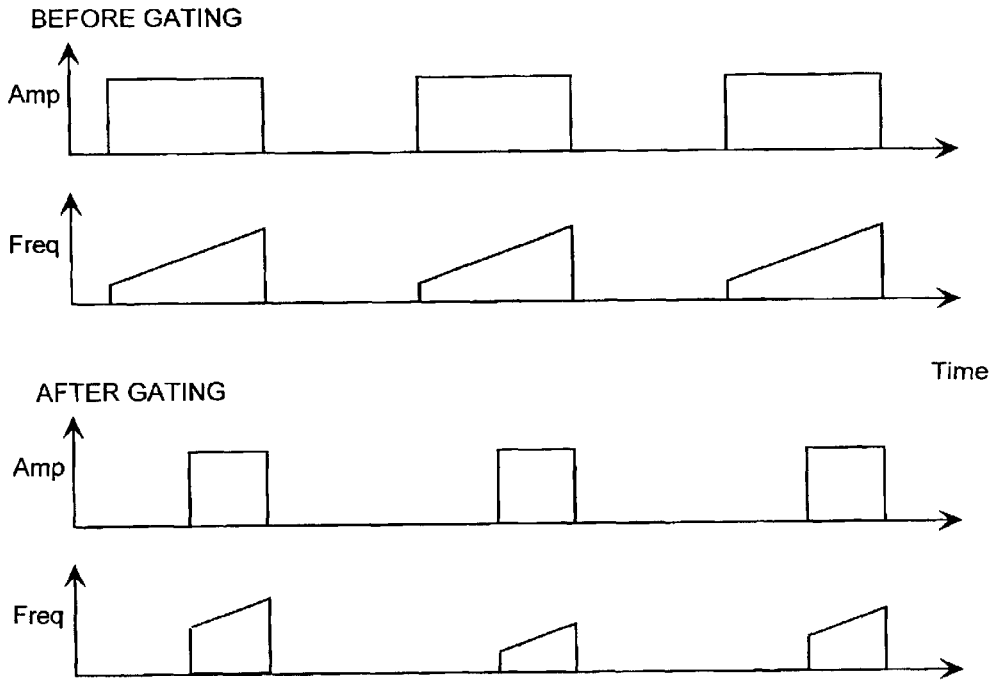
FIG. 3 illustrates amplitude and frequency vs. time for signals produced using a gated chirp signal.

It should also be noted that in both embodiments described above, an RF gating signal may be inserted before the power amplifier (PA) to set the width of the RF tone burst. The use of such a gating switch also enables a third embodiment, as shown in FIG. 3. In this embodiment a chirped waveform is used to excite the transducer. The bandwidth of the frequency sweep of the chirp is adjusted so that the frequency range spans the entire range of required frequency changes for all possible fluid heights. The gating signal, whose delay is controlled by the fluid height information, then selects the portion of the chirp signal to apply to the transducer so that the selected frequency range corresponds to the particular fluid height. One potential disadvantage of such a gating system is that the exact time of ejection of the drops will depend on the particular fluid height. This could translate into a variation in the position of drops on the receiver plate. However, the maximal effects of such variation can be determined to insure that they are within tolerance levels. FIG. 3 illustrates amplitude and frequency vs. time for signals produced using a gated chirp signal It is, of course, understood that optimal variations of the above-discussed parameters will depend upon the specific fluids and lens selected and such modifications are well within the abilities of one of skill in the art.

Illustrated Embodiments:

FIG. 4 illustrates an embodiment of the inventive device in simplified cross-sectional view. As with all figures referenced herein, in which like parts are referenced by like numerals, FIG. 4 is not to scale, and certain dimensions may be exaggerated for clarity of presentation. The device 31 includes a plurality of reservoirs, i.e., at least two reservoirs, with a first reservoir indicated at 33 and a second reservoir indicated at 35, each adapted to contain a fluid having a fluid surface, e.g., a first fluid 34 and a second fluid 36 having fluid surfaces respectively indicated at 37 and 39. Fluids 34 and 36 may be the same or different. As shown, the reservoirs are of substantially identical construction so as to be substantially acoustically indistinguishable, but identical construction is not a requirement. The reservoirs are shown as separate removable components but may, if desired, be fixed within a plate or other substrate. For example, the plurality of reservoirs may comprise individual wells in a well plate, optimally although not necessarily arranged in an array. Each of the reservoirs 33 and 35 is preferably axially symmetric as shown, having vertical walls 41 and 43 extending upward from circular reservoir bases 45 and 47 and terminating at openings 49 and 51, respectively, although other reservoir shapes may be used. The material and thickness of each reservoir base should be such that acoustic radiation may be transmitted therethrough and into the fluid contained within the reservoirs.

The device also includes an acoustic ejector 53 comprised of an acoustic radiation generator 55 for generating acoustic radiation and a focusing means 57 for focusing the acoustic radiation at a focal point within the fluid from which a droplet is to be ejected, near the fluid surface. As shown in FIG. 5, the focusing means 57 may comprise a single solid piece having a concave surface 59 for focusing acoustic radiation, but the focusing means may be constructed in other ways as discussed below. The acoustic ejector 53 is thus adapted to generate and focus acoustic radiation so as to eject a droplet of fluid from each of the fluid surfaces 37 and 39 when acoustically coupled to reservoirs 33 and 35 and thus to fluids 34 and 36, respectively. The acoustic radiation generator 55 and the focusing means 57 may function as a single unit controlled by a single controller, or they may be independently controlled, depending on the desired performance of the device. Typically, single ejector designs are preferred over multiple ejector designs because accuracy of droplet placement and consistency in droplet size and velocity are more easily achieved with a single ejector.

As will be appreciated by those skilled in the art, any of a variety of focusing means may be employed in conjunction with the present invention. Lenses having an F-number of greater than approximately 2 are preferred. For example, one or more curved surfaces may be used to direct acoustic radiation to a focal point near a fluid surface. One such technique is described in U.S. Pat. No. 4,308,547 to Lovelady et al. Focusing means with a curved surface have been incorporated into the construction of commercially available acoustic transducers such as those manufactured by Panametrics Inc. (Waltham, Mass.). In addition, Fresnel lenses are known in the art for directing acoustic energy at a predetermined focal distance from an object plane. See, e.g., U.S. Pat. No. 5,041,849 to Quate et al. Fresnel lenses may have a radial phase profile that diffracts a substantial portion of acoustic energy into a predetermined diffraction order at diffraction angles that vary radially with respect to the lens. The diffraction angles should be selected to focus the acoustic energy within the diffraction order on a desired object plane.

There are also a number of ways to acoustically couple the ejector 53 to each individual reservoir and thus to the fluid therein. One such approach is through direct contact as is described, for example, in U.S. Pat. No. 4,308,547 to Lovelady et al., wherein a focusing means constructed from a hemispherical crystal having segmented electrodes is submerged in a liquid to be ejected. The aforementioned patent further discloses that the focusing means may be positioned at or below the surface of the liquid. However, this approach for acoustically coupling the focusing means to a fluid is undesirable when the ejector is used to eject different fluids in a plurality of containers or reservoirs, as repeated cleaning of the focusing means would be required in order to avoid cross-contamination. The cleaning process would necessarily lengthen the transition time between each droplet ejection event. In addition, in such a method, fluid would adhere to the ejector as it is removed from each container, wasting material that may be costly or rare.

Thus, a preferred approach would be to acoustically couple the ejector to the reservoirs and reservoir fluids without contacting any portion of the ejector, e.g., the focusing means, with any of the fluids to be ejected. To this end, the present invention provides an optional ejector positioning means for positioning the ejector in controlled and repeatable acoustic coupling with each of the fluids in the reservoirs to eject droplets therefrom without submerging the ejector therein. This typically involves direct or indirect contact between the ejector and the external surface of each reservoir. When direct contact is used in order to acoustically couple the ejector to each reservoir, it is preferred that the direct contact is wholly conformal to ensure efficient acoustic energy transfer. That is, the ejector and the reservoir should have corresponding surfaces adapted for mating contact. Thus, if acoustic coupling is achieved between the ejector and reservoir through the focusing means, it is desirable for the reservoir to have an outside surface that corresponds to the surface profile of the focusing means. Without conformal contact, efficiency and accuracy of acoustic energy transfer may be compromised. In addition, since many focusing means have a curved surface, the direct contact approach may necessitate the use of reservoirs having a specially formed inverse surface.

Figure 4A:
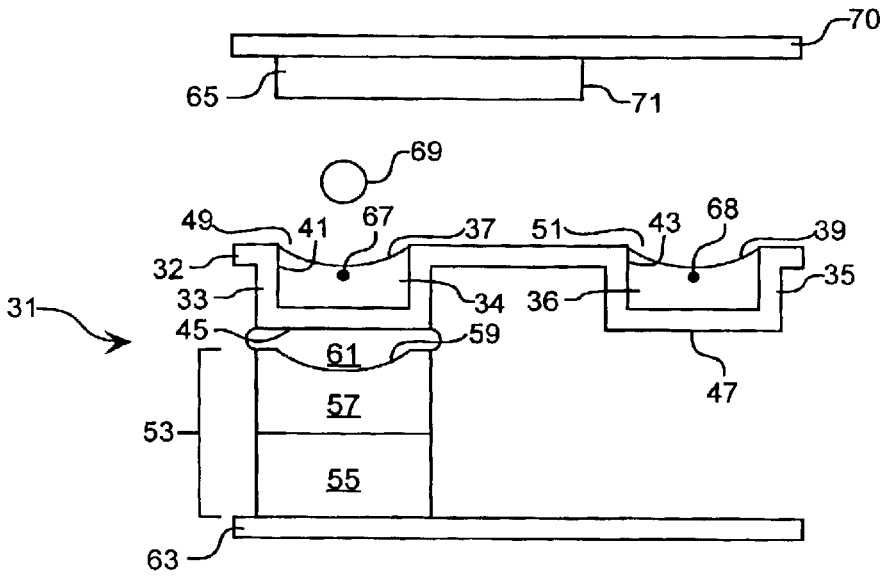
FIGS. 4*a* and 4*b*, collectively referred to as FIG. 4, schematically illustrate in simplified cross-sectional view an embodiment of the inventive device comprising first and second reservoirs, an acoustic ejector, and an ejector positioning means.

Optimally, acoustic coupling is achieved between the ejector and each of the reservoirs through indirect contact, as illustrated in FIG. 4*a*. In the figure, an acoustic coupling medium 61 is placed between the ejector 53 and the base 45 of reservoir 33, with the ejector and reservoir located at a predetermined distance from each other. The acoustic coupling medium may be an acoustic coupling fluid, preferably an acoustically homogeneous material in conformal contact with both the acoustic focusing means 57 and each reservoir. In addition, it is important to ensure that the fluid medium is substantially free of material having different acoustic properties than the fluid medium itself. As shown, the first reservoir 33 is acoustically coupled to the acoustic focusing means 57 such that the acoustic radiation source generates an acoustic wave, which is in turn directed by the focusing means 57 into the acoustic coupling medium 61, which then transmits the acoustic radiation into the reservoir 33.

In operation, reservoirs 33 and 35 of the device are each filled with first and second fluids 34 and 36, respectively, as shown in FIG. 4. The acoustic ejector 53 is positionable by means of ejector positioning means 63, shown below reservoir 33, in order to achieve acoustic coupling between the ejector and the reservoir through acoustic coupling medium 61. Substrate 65 is positioned above and in proximity to the first reservoir 33 such that one surface of the substrate, shown in FIG. 4 as underside surface 71, faces the reservoir and is substantially parallel to the surface 37 of the fluid 34 therein. Once the ejector, the reservoir and the substrate are in proper alignment, the height of the fluid surface 37 within the reservoir with respect to the focusing means 57 is measured. This measurement is preferably done via echo ranging, i.e., via activation of the acoustic radiation generator 55 at a power level and pulse width that is insufficient to eject a droplet but sufficient to provide distance data. Such methods are well known in the art. Once the distance has been ascertained, the preconstructed frequency/drop size correlation data is used to select the frequency and amplitude of the RF signal which then activates the acoustic radiation generator 55 to produce acoustic radiation that is directed by the focusing means 57 to a focal point 67 near the fluid surface 37 of the first reservoir. As a result, droplet 69, having the desired size, is ejected from the fluid surface 37 onto a designated site on the underside surface 71 of the substrate.

The ejected droplet may be retained on the substrate surface by solidifying thereon after contact; in such an embodiment, it is necessary to maintain the substrate at a low temperature, i.e., a temperature that results in droplet solidification after contact. Alternatively, or in addition, a molecular moiety within the droplet attaches to the substrate surface after contract, through adsorption, physical immobilization, or covalent binding.

Figure 4B:
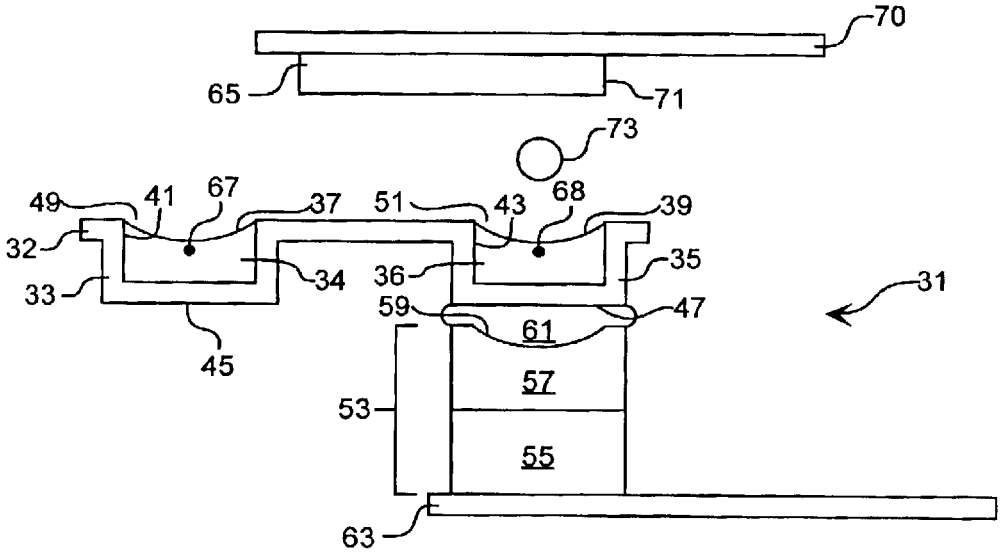

Then, as shown in FIG. 4*b*, a substrate positioning means 70 repositions the substrate 65 over reservoir 35 in order to receive a droplet therefrom at a second designated site. FIG. 4*b* also shows that the ejector 53 has been repositioned by the ejector positioning means 63 below reservoir 35 and in acoustically coupled relationship thereto by virtue of acoustic coupling medium 61. Once properly aligned as shown in FIG. 4*b*, the height of the fluid surface 39 within reservoir 35 is measured, the preconstructed frequency/drop size correlation data used to select the frequency and amplitude of the RF signal to activate the acoustic radiation generator 55 to produce acoustic radiation that is then directed by focusing means 57 to a focal point within fluid 36 near the fluid surface 39, thereby ejecting droplet 73 onto the substrate.

It should be evident that such operation is illustrative of how the inventive device may be used to eject a plurality of fluids from reservoirs in order to form a pattern, e.g., an array, on the substrate surface 71. It should be similarly evident that the device may be adapted to eject a plurality of droplets from one or more reservoirs onto the same site of the substrate surface and may also be used to transfer materials from one well plate to another. One of ordinary skill in the art will recognize that this type of transfer may be carried out even when both the ejector and substrate are in continuous motion. It should be further evident that a variety of combinations of reservoirs, well plates and/or substrates may be used in using the inventive device to engage in fluid transfer. It should be still further evident that any reservoir may be filled with a fluid through acoustic ejection prior to deploying the reservoir for further fluid transfer, e.g., for array deposition.

As discussed above, either individual, e.g., removable, reservoirs or well plates may be used to contain fluids that are to be ejected, wherein the reservoirs or the wells of the well plate are preferably substantially acoustically indistinguishable from one another. Also, unless it is intended that the ejector be submerged in the fluid to be ejected, the reservoirs or well plates must have acoustic transmission properties sufficient to allow acoustic radiation from the ejector to be conveyed to the surfaces of the fluids to be ejected. Typically, this involves providing reservoir or well bases that are sufficiently thin to allow acoustic radiation to travel therethrough without unacceptable dissipation. In addition, the material used in the construction of reservoirs must be compatible with the fluids contained therein. Thus, if it is intended that the reservoirs or wells contain an organic solvent such as acetonitrile, polymers that dissolve or swell in acetonitrile would be unsuitable for use in forming the reservoirs or well plates. For water-based fluids, a number of materials are suitable for the construction of reservoirs and include, but are not limited to, ceramics such as silicon oxide and aluminum oxide, metals such as stainless steel and platinum, and polymers such as polyester and polytetrafluoroethylene.

Many well plates suitable for use with the inventive device are commercially available and may contain, for example, 96, 384, 1536 or 3456 wells per well plate. Manufactures of suitable well plates for use in the inventive device include Corning Inc. (Corning, N.Y.) and Greiner America, Inc. (Lake Mary, Fla.). However, the availability of such commercially available well plates does not preclude manufacture and use of custom-made well plates containing at least about 10,000 wells, or as many as 100,000 wells or more. For array forming applications, it is expected that about 100,000 to about 4,000,000 reservoirs may be employed. In addition, to reduce the amount of movement needed to align the ejector with each reservoir or reservoir well, it is preferable that the center of each reservoir is located not more than about 1 centimeter, preferably not more than about 1 millimeter and optimally not more than about 0.5 millimeter from a neighboring reservoir center.

Moreover, the device may be adapted to eject fluids of virtually any type and amount desired. The fluid may be aqueous and/nor nonaqueous. Nonaqueous fluids include, for example, water, organic solvents, and lipidic liquids, and, because the invention is readily adapted for use with high temperatures, fluids such as liquid metals, ceramic materials, and glasses may be used; see, e.g., co-pending patent application U.S. Ser. No. 09/962,730 ("FOCUSED ACOUSTIC ENERGY METHOD FOR GENERATING DROPLETS OF IMMISCIBLE FLUIDS"), inventors Ellson, and Mutz, and Foote filed Sep. 21, 2001, and assigned to Picoliter Inc. (Mountain View, Calif.) which published as U.S. Published Application No. 2002/037375. Furthermore, because of the precision that is possible using the inventive technology, the device may be used to eject droplets from a reservoir adapted to contain no more than about 100 nanoliters of fluid, preferably no more than 10 nanoliters of fluid. In other instances, the ejector may be adapted to eject a droplet from a reservoir adapted to contain about 1 to about 100 microliters of fluid. This is particularly useful when the fluid to be ejected contains rare or expensive biomolecules, wherein it may be desirable to eject droplets having a volume of about up to 1 picoliter. When large F-numbered lenses are used, it is possible to eject drops from reservoirs wherein the ratio of the distance to the surface of the fluid is much greater than the aperture contained within the base of the reservoir, i.e., 3 to 5 times greater, allows for the ejection of droplets adapted to contain anywhere from approximately 0.01 picoliters to approximately 100 nanoliters with droplets ranging from approximately 100 picoliters to approximately 100 nanoliters being more common.

From the above, it is evident that various components of the device may require individual control or synchronization to form an array on a substrate. For example, the ejector positioning means may be adapted to eject droplets from each reservoir in a predetermined sequence associated with an array to be prepared on a substrate surface. Similarly, the substrate positioning means for positioning the substrate surface with respect to the ejector may be adapted to position the substrate surface to receive droplets in a pattern or array thereon. Either or both positioning means, i.e., the ejector positioning means and the substrate positioning means, may be constructed from, e.g., levers, pulleys, gears, a combination thereof, or other mechanical means known to one of ordinary skill in the art. It is preferable to ensure that there is a correspondence between the movement of the substrate, the movement of the ejector, and the activation of the ejector to ensure proper pattern formation. A primary advantage of the present method is that, due to the use of RF frequency alteration, repositioning of the ejector in the z direction is unnecessary.

Moreover, the device may include other components that enhance performance. For example, as alluded to above, the device may further comprise cooling means for lowering the temperature of the substrate surface to ensure, for example, that the ejected droplets adhere to the substrate. The cooling means may be adapted to maintain the substrate surface at a temperature that allows fluid to partially or preferably substantially solidify after the fluid comes into contact therewith. In the case of aqueous fluids, the cooling means should have the capacity to maintain the substrate surface at about 0° C. In addition, repeated application of acoustic energy to a reservoir of fluid may result in heating of the fluid. Heating can of course result in unwanted changes in fluid properties such as viscosity, surface tension and density. Thus, the device may further comprise means for maintaining fluid in the reservoirs at a constant temperature. Design and construction of such temperature maintaining means are known to one of ordinary skill in the art and may comprise, e.g., components such as a heating element, a cooling element, or a combination thereof. For many biomolecular deposition applications, it is generally desired that the fluid containing the biomolecule is kept at a constant temperature without deviating more than about 1° C. or 2° C. therefrom. In addition, for a biomolecular fluid that is particularly heat sensitive, it is preferred that the fluid be kept at a temperature that does not exceed about 10° C. above the melting point of the fluid, preferably at a temperature that does not exceed about 5° C. above the melting point of the fluid. Thus, for example, when the biomolecule-containing fluid is aqueous, it may be optimal to keep the fluid at about 4° C. during ejection.

The device of the invention enables ejection of droplets at a rate of at least about 1,000,000 droplets per minute from the same reservoir, and at a rate of at least about 100,000 drops per minute from different reservoirs. In addition, current positioning technology allows for the ejector positioning means to move from one reservoir to another quickly and in a controlled manner, thereby allowing fast and controlled ejection of different fluids. That is, current commercially available technology allows the ejector to be moved from one reservoir to another, with repeatable and controlled acoustic coupling at each reservoir, in less than about 0.1 second for high performance positioning means and in less than about 1 second for ordinary positioning means. A custom designed system will allow the ejector to be moved from one reservoir to another with repeatable and controlled acoustic coupling in less than about 0.001 second.

In order to provide a custom designed system, it is important to keep in mind that there are two basic kinds of motion: pulse and continuous. Pulse motion involves the discrete steps of moving an ejector into position, emitting acoustic energy, and moving the ejector to the next position; again, using a high performance positioning means with such a method allows repeatable and controlled acoustic coupling at each reservoir in less than 0.1 second. A continuous motion design, on the other hand, moves the ejector and the reservoirs continuously, although not at the same speed, and provides for ejection during movement. Since the pulse width is very short, this type of process enables over 10 Hz reservoir transitions, and even over 1000 Hz reservoir transitions and provides for exceptionally rapid ejection rates.

It is to be understood that while the invention has been described in conjunction with the preferred specific embodiments thereof, the foregoing description is intended to illustrate and not limit the scope of the invention. Other aspects, advantages and modifications will be apparent to those skilled in the art to which the invention pertains. All patents, patent applications, journal articles and other references cited herein are incorporated by reference in their entireties.

We claim:

1. A device for acoustically ejecting a fluid droplet of a desired droplet size toward a designated site on a substrate surface, comprising:

(a) a reservoir having an aperture that enables conduction of acoustic energy in a substantially uniform manner;

(b) an ejector comprised of (i) an acoustic radiation generator for generating acoustic radiation and (ii) a focusing means capable of focusing the generated acoustic radiation to emit a droplet from a surface of a fluid contained within the reservoir the surface being a measured distance from the focusing means;

(c) a variable frequency and amplitude RF signal generator in electrical communication with the ejector;

(d) means for determining the measured distance;

(e) means for selecting the frequency and amplitude of the RF signal to be communicated to the acoustic energy generator using the measured distance, thereby enabling ejection of a droplet having the desired size.

2. The device of claim 1, further comprising:

(f) a means for positioning the ejector in an acoustic coupling relationship with the reservoir.

3. The device of claim 2, further comprising a plurality of reservoirs, wherein the positioning means is adapted to repeatedly reposition the ejector so to enable ejection of a droplet from each of the reservoirs toward designated sites on the substrate surface.

4. The device of claim 3, wherein each reservoir comprises an individual well in a well plate.

5. The device of claim 4, wherein the well plate contains at least 96 wells.

6. The device of claim 1, wherein the designated site on the substrate surface comprises an individual well in a well plate.

7. The device of claim 1, comprising at least about 10,000 reservoirs.

8. The device of claim 7, comprising in the range of about 100,000 to about 4,000,000 reservoirs.

9. The device of claim 1, further comprising cooling means for lowering the temperature of the substrate surface.

10. The device of claim 2, wherein the acoustic coupling relationship comprises positioning the ejector such that the acoustic radiation is generated and focused external to the reservoir.

11. The device of claim 3, wherein at least one of the reservoirs is adapted to contain no more than about 100 nanoliters of fluid.

12. The device of claim 11, wherein at least one of the reservoirs is adapted to contain no more than about 10 nanoliters of fluid.

13. The device of claim 3, wherein at least one reservoir contains a fluid.

14. The device of claim 13, wherein each reservoir contains a different fluid.

15. The device of claim 13, wherein at least one of reservoir contains two substantially immiscible fluids.

16. The device of claim 3, further comprising a means for maintaining a fluid in each reservoir at a constant temperature.

17. The device of claim 3, further comprising a substrate positioning means for positioning the substrate surface with respect to the ejector.

18. The device of claim 3, comprising a single ejector.

19. The device of claim 3, wherein the RF signal generator comprises a voltage controlled oscillator.

20. The device of claim 3, wherein the RF signal generator comprises an arbitrary waveform generator.

21. The device of claim 3, wherein the RF signal has a chirped waveform and the means for selecting the frequency of the RF signal to be communicated to the acoustic energy generator comprises a gating signal.

22. The device of claim 3, wherein the means for determining the measured distance comprises the ejector.

23. The device of claim 3, wherein the means for selecting the frequency and amplitude of the RF signal to be communicated to the acoustic energy generator comprises a reference table prepared by experimentally determining the correlation between droplet size, velocity, frequency, and measured distance.

24. The device of claim 23, wherein the reference table is in the form of an electronic database and is accessed via a computer.

25. The device of claim 3, wherein the aperture in each reservoir has a selected cross-sectional width and the ratio of the measured distance to the cross-sectional width for each reservoir when the reservoir is acoustically coupled to the ejector is greater than about 2:1.

26. A method of ejecting identically sized droplets with a variable amplitude and frequency RF signal from at least two fluid-containing reservoirs having substantially identical acoustic ejection properties but each containing fluids having surfaces of different heights and the surface of at least one fluid is outside a nominal focal zone of an ejector that has been placed in an acoustically coupled relationship thereto, comprising a. measuring the distance from the focusing means to the surface of the fluid in each reservoir; and b. selecting the frequency and amplitude content of the RF signal used to eject the droplets for each reservoir based on the measured distance for the fluid contained therein.

27. The method of claim 26, wherein each of the identically sized droplets has a volume ranging from approximately 100 picoliters to approximately 100 nanoliters.

28. The method of claim 26, wherein each measuring step is carried out acoustically.

29. The method of claim 28, wherein each measuring step is carried out using acoustic radiation from the ejector.

30. The method of claim 26, wherein the RF signal is generated by a voltage controlled oscillator.

31. The method of claim 26, wherein the RF signal is generated by an arbitrary waveform generator.

32. The method of claim 26, wherein the RF signal has a chirped waveform and the means for selecting the frequency and amplitude of the RF signal to be communicated to the acoustic energy generator comprises a gating signal.

33. The method of claim 26, wherein the ejector comprises the means for measuring the distance from the focusing means to the surface of the fluid in each reservoir.

34. The method of claim 26, wherein the means for selecting the frequency and amplitude of the RF signal to be communicated to the acoustic energy generator comprises a reference table prepared by experimentally determining the correlation between droplet size, frequency, amplitude, droplet velocity, and measured distance.

35. The method of claim 26, wherein each reservoir has an aperture having a selected cross-sectional width, and the ratio of the measured distance to the cross-sectional width for each reservoir is greater than about 2:1.

36. The method of claim 26, wherein movement of the ejector between the reservoirs is restricted to a single plane perpendicular to the direction of the propagation of the acoustic radiation.

37. A method for ejecting a fluid from a fluid reservoir toward designated sites on a substrate surface, comprising:

(a) providing a device comprised of:

(i) a fluid-containing reservoir having an aperture that enables conduction of acoustic energy in a substantially uniform manner;

(ii) an ejector comprised of (1) an acoustic radiation generator for generating acoustic radiation and (2) a focusing means capable of focusing the generated acoustic radiation to emit a droplet from a surface of the fluid within the reservoir;

(iii) a variable frequency and amplitude RF signal generator in electrical communication with the ejector;

(iv) means for measuring the distance from the focusing means to the surface of the fluid in the reservoir and (v) means for selecting the frequency and amplitude of the RF signal to be communicated to the acoustic energy generator using the measured distance, thereby enabling ejection of a droplet having a desired size;

(b) positioning the ejector so as to be in acoustically coupled relationship to the reservoir;

(c) measuring the distance from the focusing means to the surface of the fluid in the reservoir;

(d) selecting the frequency and amplitude of the RF signal to be communicated to the acoustic energy generator; and (e) activating the ejector to generate acoustic radiation, thereby ejecting a droplet of fluid having the desired size from the fluid reservoir.

38. The method of claim 37, wherein the device comprises a plurality of fluid-containing reservoirs and a positioning means adapted to repeatedly reposition the ejector so to enable ejection of a droplet from each of the reservoirs toward designated sites on the substrate surface.

39. The method of claim 38, further comprising the following additional steps;

(f) positioning the ejector so as to be in acoustically coupled relationship to a second reservoir containing a second fluid;

(g) measuring the distance to the surface of the second fluid contained within the second fluid-containing reservoir;

(h) selecting the frequency and amplitude of RF signal to be communicated to the acoustic energy generator; and (i) activating the ejector to generate acoustic radiation, thereby ejecting a droplet of the second fluid of the desired size from the second reservoir toward a second designated site on the substrate surface.

40. The method of claim 39, further comprising repeating steps (f) through (i) with one or more additional fluid-containing reservoirs.

41. The method of claim 40, wherein step (f) movement of the ejector is restricted to a single plane perpendicular to the direction of the propagation of the acoustic radiation.

42. The method of claim 39, wherein step (f) movement of the ejector is restricted to a single plane perpendicular to the direction of the propagation of the acoustic radiation.

43. The method of claim 39, wherein the amplitude of the RF signal is selected in order to adjust droplet ejection velocity.

* * * * *